United States Patent [19]

Freermann

[11] Patent Number: 4,509,440

[45] Date of Patent: Apr. 9, 1985

[54] STITCHING ASSEMBLY FOR SELVEDGING MACHINE

[75] Inventor: Johannes Freermann, Ochtrup, Fed. Rep. of Germany

[73] Assignee: Carl Schmale KG, Ochtrup, Fed. Rep. of Germany

[21] Appl. No.: 507,870

[22] Filed: Jun. 24, 1983

[30] Foreign Application Priority Data

Jul. 21, 1982 [DE] Fed. Rep. of Germany ..... 3227198

[51] Int. Cl.[3] ..... D05B 35/10; D05B 29/06

[52] U.S. Cl. ..... 112/153; 112/235

[58] Field of Search ..... 112/153, 150, 151, 141, 112/136, 147, 235, 260

[56] References Cited

U.S. PATENT DOCUMENTS

| | | | |
|---|---|---|---|
| 3,140,680 | 7/1964 | Brenner | 112/151 |
| 3,146,743 | 9/1964 | Minehan | 112/151 |
| 3,817,195 | 6/1974 | Meier | 112/150 X |

*Primary Examiner*—Peter Nerbun

*Attorney, Agent, or Firm*—Karl F. Ross; Herbert Dubno

[57] ABSTRACT

A stitching assembly for a sewing machine has a stationary stitch plate having a flat upper face defining a stitching location, provided on the face adjacent the stitching location with an upstanding edge guide extending in and defining a transport direction, and formed with an upwardly open elongated groove extending upstream in the transport direction from the stitching location and having an outer flank turned toward and mainly parallel to the edge guide and an inner flank turned away from and mainly parallel to the edge guide. A presser foot has a sole plate with a lower face turned toward and confronting the upper face of the stitch plate at the stitching location and provided on its lower face with a downwardly projecting guide ridge that extends in the transport direction and that has an inner flank turned toward and generally parallel to the edge guide and an outer flank turned away from and generally parallel to the edge guide. The outer flank of the ridge is aligned over the inner flank of the groove. Thus a thick web workpiece can have a turned-over thin edge held between the ridge and the edge guide while the thick portion of the workpiece lies outside the ridge.

6 Claims, 5 Drawing Figures

STITCHING ASSEMBLY FOR SELVEDGING MACHINE

FIELD OF THE INVENTION

The present invention relates to a stitching assembly for a sewing machine. More particularly this invention concerns the unit formed of the stitch plate, presser foot, and transporter in an automatic selvedging apparatus.

BACKGROUND OF THE INVENTION

A sewing machine, such as used in automatic selvedging equipment of the type described in my jointly filed and copending patent applications Ser. No. 507,868, now U.S. Pat. No. 4,448,138 and Ser. No. 507,869, now U.S. Pat. No. 4,450,780, has a stitching assembly comprised of a stitch plate formed with a needle hole, a presser foot that urges the web workpiece down against the smooth upper face of this plate, and transporters that can engage through the stitch plate to advance the workpiece in a transport direction. Typically the presser foot is also formed with a needle hole or slot and a vertically reciprocal needle can pierce through the goods between the foot and stitch plate in the intervals between advance steps of the web through the assembly. The transporters move in a standard up-back and down-forward movement.

When the web edge is the doubly folded-over edge of terrycloth having no-pile or loopfree edges such a machine rarely stitches true. Guiding the folded-over edge and feeding it accurately to the stitching location is fairly difficult, so the product is often spoiled.

OBJECTS OF THE INVENTION

It is therefore an object of the present invention to provide an improved stitching assembly for a sewing machine.

Another object is the provision of such a stitching assembly for a sewing machine which overcomes the above-given disadvantages, that is which can accurately stitch together the folded-over edges of a terrycloth web.

SUMMARY OF THE INVENTION

A stitching assembly for a sewing machine according to the invention has a stationary stitch plate having a flat upper face defining a stitching location, provided on the face adjacent the stitching location with an upstanding edge guide extending in and defining a transport direction, and formed with an upwardly open elongated groove extending upstream in the transport direction from the stitching location and having an outer flank turned toward and mainly parallel to the edge guide and an inner flank turned away from and mainly parallel to the edge guide. A presser foot has a sole plate with a lower face turned toward and confronting the upper face of the stitch plate at the stitching location and provided on its lower face with a downwardly projecting guide ridge that extends in the transport direction and that has an inner flank turned toward and generally parallel to the edge guide and an outer flank turned away from and generally parallel to the edge guide. The outer flank of the ridge is aligned over the inner flank of the groove. Thus a thick web workpiece can have a turned-over thin edge held between the ridge and the edge guide while the thick portion of the workpiece lies outside the ridge. The sole plate and stitch plate are formed between the edge and the ridge with vertically aligned needle holes. At least one transporter is engageable through the stitch plate between the ridge and the edge guide with the turned-over edge of the workpiece and displaceable in the transport direction. Thus the transporter can engage the web workpiece and advance it in the transport direction.

With this system the loop-free web edge is separated from the looped central part by the ridge and inner groove flank. The workpiece therefore naturally guides itself through the stitching assembly, ensuring that a perfectly even stitched selvedge will be produced.

Of course the system of this invention will function without the transporters, or in machines where the external goods transport system is not effective in the stitching location. Accurate guiding of the selvedge will be assured in any case.

According to a feature of this invention relative to the transport direction the sole plate has a turned up front end. This prevents it from snagging on the goods and facilitates initial fitting of the goods into the assembly.

The inner flank of the groove according to the invention converges with the guide edge from a point upstream in the direction from the stitching location. In other words the groove flanks flare upstream in the transport direction. The inner groove flank is undercut. It is also possible according to the invention for the inner flank of the grooves to have a straight front part that converges with the guide edge from a point upstream in the direction from the stitching location.

The lower face of the sole plate in accordance with the invention has a flat inside region between the ridge and guide edge spaced a relatively short distance from the upper face of the stitch plate and an outer region to the other side of the ridge spaced a relatively great distance from the upper face of the stitch plate. Thus the same pressure is applied to the folded-over selvedge and to the center pile portion.

DESCRIPTION OF THE DRAWING

The above and other features and advantages will become more readily apparent from the following, reference being made to the accompanying drawing in which.

SPECIFIC DESCRIPTION

Figure 1:
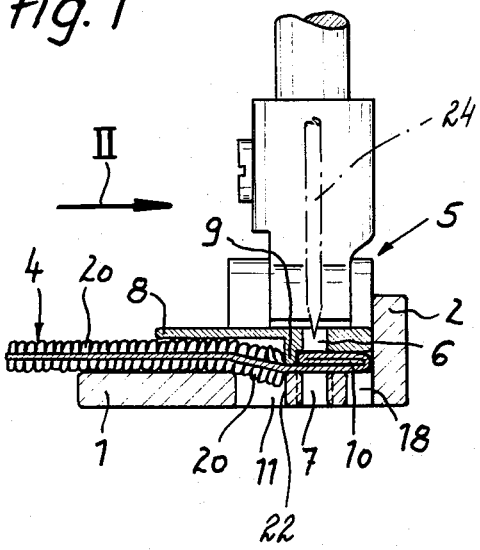
FIG. 1 is a cross section through the sewing-machine stitching assembly according to this invention.
Figure 3:
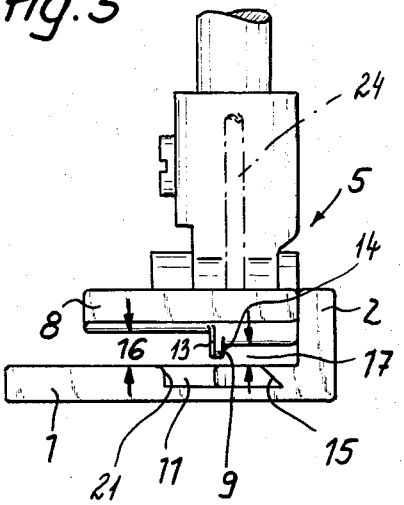
FIG. 3 is a front view taken in the direction of arrow III of FIG. 2.
Figure 2:
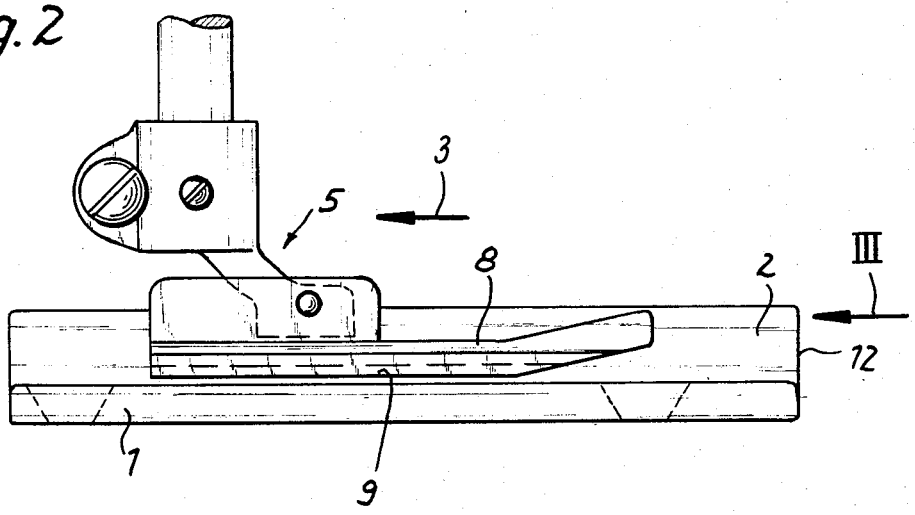
FIG. 2 is a side view taken in the direction of arrow II of FIG. 1.
Figure 4:
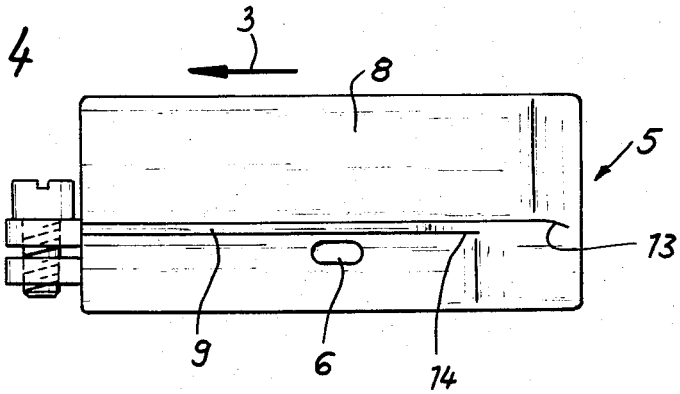
FIG. 4 is a bottom view of the presser foot.

As seen in the drawing a stitching assembly has a stationary stitch plate 1 provided with a planar upstanding edge guide 2 extending in and defining a transport direction 3. A web workpiece 4 is held down on top of this stitch plate 1 by a presser foot 5 that is biased downward by a standard spring and that is formed with a throughgoing needle hole 6 aligned with a corresponding needle hole 7 in the stitch plate 1.

The presser foot 5 has a sole plate 8 which extends parallel to the stitch plate 1 in the transport direction 3 and whose front end is turned up like a ski. The sole plate 8 is formed adjacent the stitch hole 6 with a ridge 9 extending in the transport direction 3 parallel to the edge guide 2. This ridge 9 has an outer flank or edge 13 turned away from the guide edge 2 and an inner flank or edge 14 turned toward and confronting it. The lower face of the sole plate 3 is higher outside the ridge 9, that is it is spaced a relatively great distance 16 above the top face of the stitch plate 1 outside the ridge 9 and a relatively small distance 17 equal to about two-thirds of the distance 16 inside this ridge, that is between the ridge and the edge guide 2. Otherwise the two parts of the lower face of the sole plate 8 are planar and extend parallel to the planar upper face of the stitch plate 1 except at the turned up front end of the sole plate 8.

In addition the stitch plate 1 is formed with a groove 11 that opens upward and that has an outer flank or edge 21 turned toward and parallel to the edge guide 2 and an inner flank or edge 22 lying between the flank 21 and the guide 2. Behind or downstream relative to the direction 3 of a point 23 the edge 22 is parallel to the edge 21 and guide 2, but it diverges in front of it inward from the edge 21 toward the guide 2 and is undercut as shown at 15.

Under normal circumstances the folded-over edge 10 of the web 4 is engaged between the ridge 9 and the guide 2, while the pile or loops 20 of the terrycloth web 4 lie outside the ridge 9, partly poking down into the groove 11. This ensures excellent control of the stitching created by a needle 24 moving vertically through the superposed holes 6 and 7 in the manner well known in the art.

Figure 5:
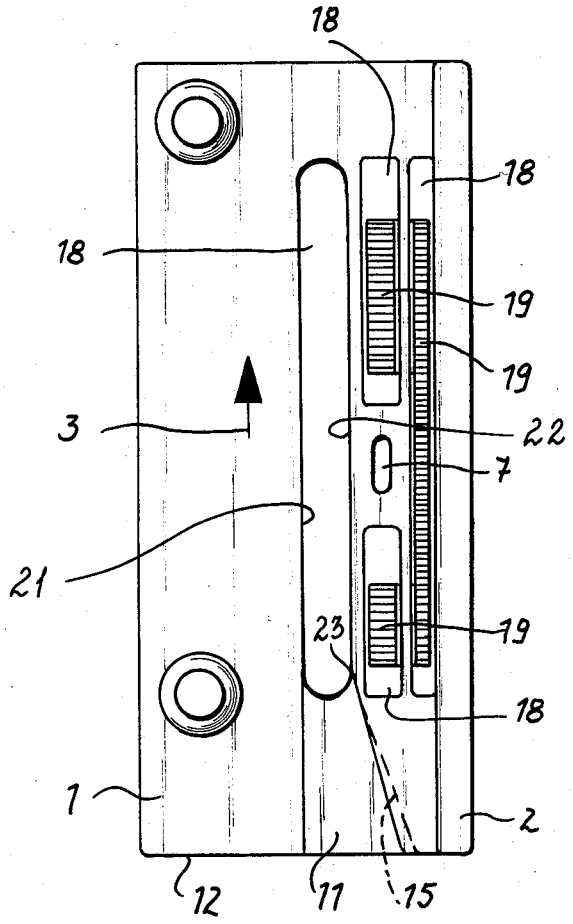
FIG. 5 is a top view of the stitch plate.

As best seen in FIG. 5 the stitch plate 1 is formed with a plurality of slots or ports 18 extending in the transport direction 3. Feet of a transporter 19 engage through these ports 18 between the ridge 9 and the guide 2. In standard fashion these transporter feet 19 move in a rectangular pattern seen from the side, first moving up through the ports 18 to push the folded-over edge 10 of the workpiece 4 up against the inside portion of the lower face of the sole plate 8, then moving horizontally back in the transport direction 3 to slide the workpiece 4 back also and tighten the previously made stitch, then drop down out of contact with the workpiece, and finally return against the travel direction to the point of beginning.

With this arrangement the thin edge of the terrycloth web 4 can be folded over as described in my abovementioned jointly filed patent applications and stitched with the arrangement of this invention. The resultant product will have a stitched and folded over edge as good as any bonded edge. Since the same pressure is applied to the folded-over edge 8 as to the region with the loops 20, the goods will lie flat at the stitching location.

I claim:

1. A stitching assembly for a sewing machine, the stitching assembly comprising:

a stationary stitch plate having a flat upper face defining a stitching location, provided on the face adjacent the stitching location with an upstanding edge guide extending in and defining a transport direction, and formed with an upwardly open elongated groove extending upstream in the transport direction from the stitching location and having an outer flank turned inward and mainly parallel to the edge guide and an inner flank turned away from and mainly parallel to the edge guide;

a presser foot having a sole plate with a lower face turned toward and confronting the upper face of the stitch plate at the stitching location and provided on its lower face with a downwardly projecting guide ridge that extends in the transport direction and that has an inner flank turned toward and generally parallel to the edge guide and an outer flank turned away from and generally parallel to the edge guide, the outer flank of the ridge being aligned over the inner flank of the groove, the inner flank of the groove diverging from the outer flank of the groove from a point upstream in the direction from the stitching location, whereby a thick web workpiece can have a turned-over thin edge held between the ridge and the edge guide while the thick portion of the workpiece lies outside the ridge, the sole plate and stitch plate being formed between the edge and the ridge with vertically aligned needle holes; and at least one transporter engageable through the stitch plate between the ridge and the edge guide with the turned-over edge of the workpiece and displaceable in the transport direction, whereby the transporter can engage the web workpiece and advance it in the transport direction.

2. The sewing-machine stitching assembly defined in claim 1 wherein relative to the transport direction the sole plate has a turned up front end.

3. The sewing-machine stitching assembly defined in claim 1 wherein the groove flanks flare upstream in the transport direction.

4. A stitching assembly for a sewing machine, the stitching assembly comprising:

a stationary stitch plate having a flat upper face defining a stitching location, provided on the face adjacent the stitching location with an upstanding edge guide extending in and defining a transport direction, and formed with an upwardly open elongated groove extending upstream in the transport direction from the stitching location and having an outer flank turned toward and mainly parallel to the edge guide and an inner flank turned away from and mainly parallel to the edge guide;

a presser foot having a sole plate with a lower face turned toward and confronting the upper face of the stitch plate at the stitching location and provided on its lower face with a downwardly projecting guide ridge that extends in the transport direction and that has an undercut inner flank turned toward and generally parallel to the edge guide and an outer flank turned away from and generally parallel to the edge guide, the outer flank of the ridge being aligned over the inner flank of the groove, whereby a thick web workpiece can have a turned-over thin edge being the ridge and the edge guide while the thick portion of the workpiece lies outside the ridge, the sole plate and stitch plate being formed between the edge and the ridge with vertically aligned needle holes; and at least one transporter engageable through the stitch plate between the ridge and the edge guide with the turned-over edge of the workpiece and displaceable in the transport direction, whereby the transporter can engage the web workpiece and advance it in the transport direction.

5. A stitching assembly for a sewing machine, the stitching assembly comprising:

a stationary stitch plate having a flat upper face defining a stitching location, provided on the face adjacent the stitching location with an upstanding edge guide extending in and defining a transport direction, and formed with an upwardly open elongated groove extending upstream in the transport direction from the stitching location and having an outer flank turned toward and mainly parallel to the edge guide and an inner flank turned away from and mainly parallel to the edge guide;

a presser foot having a sole plate with a lower face turned toward and confronting the upper face of the stitch plate at the stitching location and provided on its lower face with a downwardly projecting guide ridge that extends in the transport direction and that has an inner flank turned toward and generally parallel to the edge guide and an outer flank turned away from and generally parallel to the edge guide, the outer flank of the ridge being aligned over the inner flank of the groove, whereby a thick web workpiece can have a turned-over thin edge held between the ridge and the edge guide while the thick portion of the workpiece lies outside the ridge, the sole plate and stitch plate being formed between the edge and the ridge with vertically aligned needle holes, the inner flank of the groove having a front part that diverges from the outer flank of the groove from a point upstream in the direction from the stitching location; and at least one transporter engageable through the stitch plate between the ridge and the edge guide with the turned-over edge of the workpiece and displaceable in the transport direction, whereby the transporter can engage the web workpiece and advance it in the transport direction.

6. A stitching assembly for a sewing machine, the stitching assembly comprising:

a stationary stitch plate having a flat upper face defining a stitching location, provided on the face adjacent the stitching location with an upstanding edge guide extending in and defining a transport direction, and formed with an upwardly open elongated groove extending upstream in the transport direction from the stitching location and having an outer flank turned toward and mainly parallel to the edge guide and an inner flank turned away from and mainly parallel to the edge guide;

a presser foot having a sole plate with a lower face turned toward and confronting the upper face of the stitch plate at the stitching location and provided on its lower face with a downwardly projecting guide ridge that extends in the transport direction and that has an inner flank turned toward and generally parallel to the edge guide and an outer flank turned away from and generally parallel to the edge guide, the outer flank of the ridge being aligned over the inner flank of the groove, the lower face of the sole plate having a flat inside region between the ridge and guide edge spaced a relatively short distance from the upper face of the stitch plate and an outer region to the other side of the ridge spaced a relatively great distance from the upper face of the stitch plate, whereby a thick web workpiece can have a turned-over thin edge held between the ridge and the edge guide while the thick portion of the workpiece lies outside the ridge, the sole plate and stitch plate being formed between the edge and the ridge with vertically aligned needle holes; and at least one transporter engageable through the stitch plate between the ridge and the edge guide with the turned-over edge of the workpiece and displaceable in the transport direction, whereby the transporter can engage the web workpiece and advance it in the transport direction.

* * * * *